United States Patent [19]

Pecci et al.

[11] Patent Number: 4,595,488

[45] Date of Patent: Jun. 17, 1986

[54] MULTISTAGE PROCESS FOR THE DIRECT LIQUEFACTION OF COAL

[75] Inventors: Giancarlo Pecci, Milan; Luigi Carvani, Piacenza; Domenico Valentini, S.Donato Milanese; Michele Zaninelli, Milan, all of Italy

[73] Assignee: ENI-Ente Nazionale Idrocarburi, Rome, Italy

[21] Appl. No.: 618,181

[22] Filed: Jun. 7, 1984

[30] Foreign Application Priority Data

Jun. 8, 1983 [IT] Italy ..... 21513 A/83

[51] Int. Cl.[4] ..... C10G 1/00; C10G 1/06

[52] U.S. Cl. ..... 208/412; 208/413; 208/417; 208/418

[58] Field of Search ..... 208/8 LE, 10

[56] References Cited

U.S. PATENT DOCUMENTS

| | | | |
|---|---|---|---|
| 4,045,328 | 8/1977 | Green et al. | 208/8 LE |
| 4,048,054 | 9/1977 | Green et al. | 208/8 LE |
| 4,060,478 | 11/1977 | Lang | 208/8 LE |
| 4,075,079 | 2/1978 | Lang | 208/8 LE |
| 4,085,031 | 4/1978 | Walchuk | 208/8 LE |
| 4,113,602 | 9/1978 | Gorfaty et al. | 208/8 LE |
| 4,125,452 | 11/1978 | Effron | 208/8 LE |
| 4,132,627 | 1/1979 | Lear | 208/10 |
| 4,189,371 | 2/1980 | Maa et al. | 208/8 LE |
| 4,210,518 | 7/1980 | Wilson et al. | 208/10 |
| 4,222,844 | 9/1980 | Nizamoff | 208/10 X |
| 4,227,991 | 10/1980 | Carr et al. | 208/10 X |
| 4,297,200 | 10/1981 | Briley | 208/10 |
| 4,338,182 | 7/1982 | Vernon et al. | 208/8 LE |
| 4,410,414 | 10/1983 | Briley | 208/8 LE |

*Primary Examiner*—William G. Wright

*Attorney, Agent, or Firm*—Hedman, Gibson, Costigan & Hoare

[57] ABSTRACT

Moisture- and ash-free coking coal is micronized and admixed with a recycle oil, whereafter it is rapidly hydrogenated and one portion of the residue of the fractional distillation of the hydrogenation product is sent to hydrotreating, together with hydrogen. Conventional catalysts can be used both for the hydrogenation and the hydrotreating.

A gaseous fraction, consisting of water vapor, hydrogen sulphide, ammonia and C1-C4 hydrocarbon is obtained along with gasoline.

Gasoil can be obtained together with gasoline.

9 Claims, 1 Drawing Figure

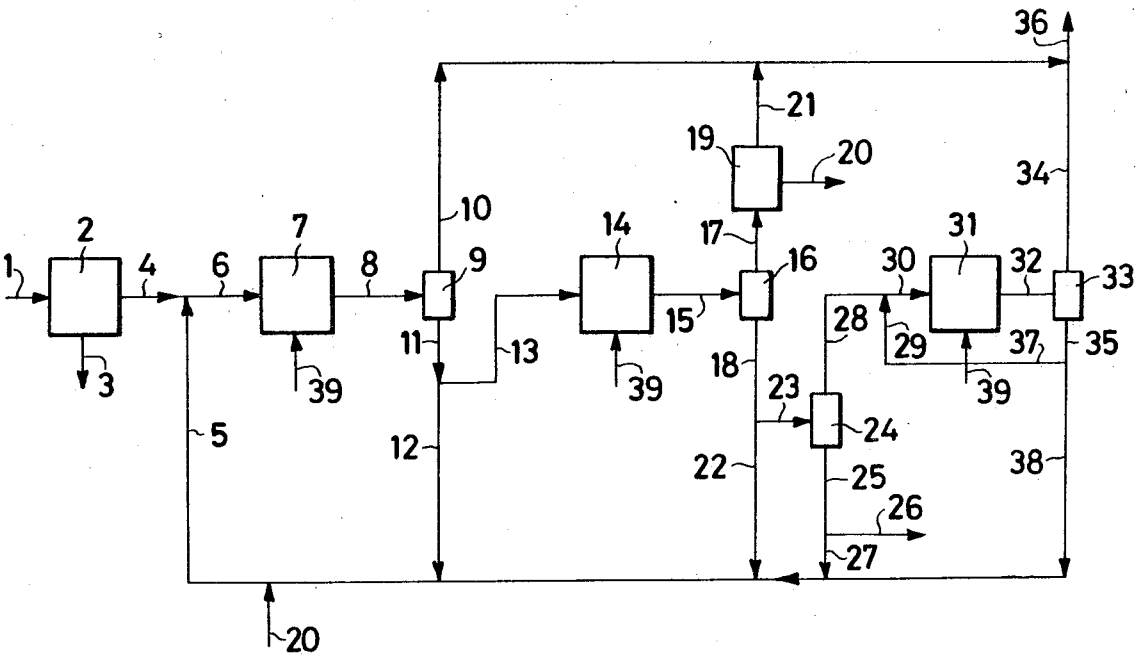
1
2
3
4
5
6
7
8
9
10
11
12
13
14
15
16
17
18
19
20
21
22
23
24
25
26
27
28
29
30
31
32
33
34
35
36
37
38
39

MULTISTAGE PROCESS FOR THE DIRECT LIQUEFACTION OF COAL

FIELD OF THE INVENTION

The present invention is related to a multistage process for the direct liquefaction of coal.

BACKGROUND OF THE INVENTION

It is well known in the art that the direct liquefaction of the coal is based on hydrogenating treatments, which increase the hydrogen/carbon ratio from 0.7–0.8 to 1 or to values near to 1.

Such processes consist in a partial cracking, under hydrogenating conditions, of the organic structure of the coal. Together with the liquid products gaseous and solid products are formed, their quantities being a function of the operating conditions and of the type of the process.

Generally speaking, the liquefaction process is based on a fundamentally thermal reaction, leading to the formation of radicals, which are stabilized by the hydrogen, such hydrogen having the scope of preventing such radicals from returning back to the form of large, less reactive molecules, and on a catalytic hydrogenation, which reduces the complexity of the molecules by means of the cracking of the bonds between some carbon atoms and other atoms of carbon, oxygen, nitrogen and sulphur.

These two reactions can be effected either as only one stage, or as two separate stages.

The results are however that the more complex ring structures are broken down, in the meanwhile oxygen, nitrogen and sulphur are reduced, or in some appropriate cases eliminated, as water, ammonia, and hydrogen sulphide.

The reactions are carried out in the presence of a solvent, usually resulting from the process itself. Such solvent has an essential function in the conversion, being able to extract the hydrogen-rich products and to dissolve the complex molecules which are formed by the thermal effect and being able to render the reaction with the hydrogen easier, as a transferring and donor agent. The ideal solvent must therefore be characterized by a high solvent power (and therefore by a highly aromatic structure for affinity reasons with the character of the solute) and good properties as a hydrogen donor (and it must therefore be easily susceptible of being hydrogenated as well as of easily transferring to the coal the hydrogen received).

From the liquefaction processes products can be obtained, ranging from refined coal, still being solid at room temperature, with a low content of sulphur and ashes, to light liquid products such as the gasoline. In the first case, the highest energy and weight yields can be obtained; upon increasing the severity of the hydrogenation reaction, leading to increasing rates of the hydrocracking reactions, both these yields decrease.

The trends which have been followed up to now for the liquefaction of the coal to medium/light products can be schematically summarized by the two following process lines:

high severity single stage liquefaction multi-stage liquefaction, with different severity rate stages.

In the first case, both the thermal reaction and the catalytic reaction takes place in a single reactor, under a compromise condition between the two optimum conditions for the two reactions: a severe hydrocracking is usually obtained, originating distillable products, with notable advantage as for the delicate and expensive separation of the liquid products and the reacted solid products, as such separation can take place in this case by means of vacuum flashing.

A disadvantage is, however, that large quantities of gaseous undesired products are originated, with a resultant high consumption of hydrogen.

By operating according to a multi-stage outline, it is possible to carry out both the thermal and the catalytic reactions under optimum conditions; more particularly, the first liquefaction stage can be effected as a low severity reaction thus realizing the transformation of the coal into a liquid extract, with a low production of gaseous compounds, thanks to the minor importance of the hydrocracking reactions.

In this case, however, since the resulting products are mostly non-distillable products, it is necessary to resort to a more complex procedure for the solid/liquid separation than the vacuum distillation procedure, such as a treatment with an anti-solvent, or a filtration treatment.

Finally, after the solid/liquid separation stage, the extracted products are submitted to a subsequent hydrocracking stage, under controlled catalytic conditions, in order to transform such extracted products into lighter products.

The advantage thus obtained consists altogether in a higher yield of use of the hydrogen supplied, with a lower global consumption rate, and in a higher flexibility of the process, resulting in a larger choice of the range of products which can be possibly obtained.

DESCRIPTION OF THE INVENTION

It has now been surprisingly found a process for the direct liquefaction of the coal, whose object is producing the largest rate of medium distillates, which makes it possible to simultaneously obtain the advantages which are separately shown by the two processes hereinbefore outlined, i.e., the single stage process and the multistage process;

the solid-liquid separation can be carried out by means of the simplest technology, i.e. as a vacuum flash process;

the dissolution reactions, which are fundamentally thermal reactions, and the catalytic hydrogenation reaction can be carried out as separate reactions, under the respectively optimum conditions.

The process for the direct liquefaction of the coal, which is the object of the present invention, comprises the following steps:

(a) submitting the coal to a pre-treatment stage, in order to reduce the ash content of such coal;

(b) submitting the so pre-treated coal, after having mixed it with a solvent, to a dissolving stage and then fractionating the product from the dissolution reaction, separating a light stream containing gaseous products, LPG, gasoline and atmospheric gas oil, a heavy stream comprising an atmospheric gas oil and a heavy stream comprising an atmospheric residue containing ashes and non reacted coal;

(c) submitting to a hydrotreating stage a share of the said heavy stream comprising the atmospheric residue, the balance of the said heavy stream being recycled as a part of the solvent to be mixed with the said pretreated coal to be submitted to the said dissolving stage, and then fractionating the product resulting from the hydrotreating reaction, separating a gaseous stream and a bottom stream consisting of the atmospheric residue, the said gaseous stream being in turn fractionated, separating therefrom a light stream comprising gaseous products, LPG, gasoline and atmospheric gas oil and a stream which is recycled as a fraction of the solvent to be mixed with the said pretreated coal before it is submitted to the dissolution stage, and the bottom stream being separated into two parts, one of such parts being recycled as a fraction of the solvent, the other part being fractionated, separating therefrom in such a way a top stream essentially consisting of a vacuum gasoil free of ashes and a bottom stream mainly consisting of ashes and not converted coal, such bottom stream being supplied to the gas generator unit for the hydrogen production;

(d) submitting to a hydrocracking stage a stream containing the vaccum gas oil and fractionating the product resulting from the hydrocracking reaction, separating a gaseous stream containing gaseous products, LPG, gasoline and atmospheric gas oil, such gaseous stream being supplied, together with the light stream of the fractionated product from the dissolution reaction and together with the light fraction from the fractionating of the gaseous stream from the fractionated product from the hydrotreating reaction, to a final fractionating stage where the end products are separated, and separating a stream comprising unconverted matter, which is mixed with the stream containing the vacuum gas oil before it is submitted to the hydrocracking.

A part of the stream comprising the unconverted matter can be re-cycled as a fraction of the solvent to be mixed with the pre-treated coal before such pre-treated coal is submitted to the dissolving reaction.

Should it be desirable, also a part of the bottom stream comprising the ashes and unconverted coal, as per the previous item (c), can be recycled as a fraction of the solvent to be mixed with the pre-treated coal.

The pre-treatment reaction, where the content of the ashes is reduced down to the lowest level from the technical and the economic viewpoint, is carried out by means of conventional techniques of the gravimetric type (treatment with heavy liquids, cyclones, oscillating sieves, vibrating tables, and so on).

The ratio of the weight of the solvent to the weight of coal is comprised between 0.5 and 5 and it is preferably comprised between 1 and 2.

The dissolving stage, where the liquefaction of the coal takes place, is carried out under low severity conditions: the temperature is comprised between 350° C. and 500° C., the contact time is comprised between 1 and 60 minutes, and it is preferably comprised between 3 and 15 minutes, the pressure of the hydrogen is not higher than 350 kg/cm$^2$, the rate of the hydrogen recycle is comprised between 400 and 4.000 cm/cm of the solvent/coal mixture.

The operating conditions of the hydrotreating stage with a reactor of the slurry type whose severity is the result of a compromise between the object of producing suitably hyrogenated components of recycle solvents and the object of making it possible to separate, downstream, the ashes from the hydrogenated stream by means of a conventional vacuum flash stage, are the following:

the pressure is comprised between 50 and 350 kg/cm$^2$ the temperature is comprised between 350° and 450° C.

the space speed is comprised between 0.2 and 2.5 h$^{-1}$ the recycle flow rate of the hydrogen is between 350 and 3.500 cu.m/cu.m of charge.

The catalytic system can be formed by oxides of the metals of the 6th and of the 8th Groups supported on $Al_2O_3$ or $Al_2O_3/SiO_2$ suitably sulphidized before being used.

The hydrocracking stage consists of two fixed bed reactors, of which, the first reactor has the purpose of selectively removing from the charge the heteroatoms (N, O, S) contained therein, the second reactor has the function of converting such charge, as selectively as possible, into medium range distillates. The operating conditions of the two reactors are:

| | 1st reactor | 2nd reactor |
|---|---|---|
| Hydrogen pressure, Kg/sq. cm | 50 ÷ 200 | 50 ÷ 200 |
| Temperature, °C. | 300 ÷ 400 | 350 ÷ 450 |
| Space speed, hours$^{-1}$ | 0.2 ÷ 2.5 | 0.2 ÷ 1.5 |
| Recycle hydrogen flow rate (cu. m/cu. m) | 300 ÷ 1.700 | 300 ÷ 2.500 |

The catalyst in the first reactor can be formed by oxides of the metals of the 6th and of the 8th Groups supported on $Al_2O_3$ and suitably sulphidized before being used.

In the second reactor a catalyst is used, which is formed by oxides of the metals of the 6th and of the 8th Groups supported on $SiO_2/Al_2O_3$.

DESCRIPTION OF THE DRAWING

The invention will be now illustrated with reference to the FIG. 1 enclosed, which represents an embodiment of the invention, which must not be considered as being limitative of the invention itself.

The coal (1) previously washed coming from the mine is supplied to the pre-treatment stage (2) where the ash content of the coal is reduced down to the lowest values possible from the technological and economic viewpoints, by means of conventional techniques of the gravimetric type (treatment with heavy liquids, cyclones, oscillating sieves, vibrating tables and similar). The ash-enriched byproduct (3) is supplied either to the gas producer stage for the production of hydrogen or to the production stage of the process utilities, together with other streams as it is shown hereinafter.

The pre-treated coal (4), at low ash content, is mixed with the process solvent (5).

The coal/solvent mixture (6) is supplied to the dissolving stage (7) where the liquefaction of the coal takes place under low severity conditions.

The reaction product (8) of the dissolving reaction is supplied to the conventional system of fractionating (9) consisting of high- and low pressure separators and of an atmospheric flash with the resultant separation of a light stream (10) consisting of gas, LPG, gasoline and atmospheric gasoil and a heavy stream (11) consisting of ash carrying atmospheric residue and of the unreacted coal. The stream (11) is divided into two streams (12) and (13). The stream (13) is supplied to the hydrotreating stage (14), whilst the stream (12) is a part of the recycle solvent (5).

The heavy stream from the dissolving stage (13) is directly supplied to the hydrotreating stage without the ashes contained therein being separated and after having been properly mixed with hydrogen. The reactor (or reactors) is/are of the slurry type with the catalyst suspended inside the effluent.

The product from the hydrotreating stage (15) is supplied to a conventional system of fractionating (16) comprising a high- and low pressure separation unit and an atmospheric flash from which the recycle hydrogen and a light stream (17) comprising gas, LPG, gasoline, atmospheric gas oil are separated.

The bottom stream (18) comprises the atmospheric residue. The stream (17) is supplied to the fractionating unit (19) where a stream (20) is separated, comprising atmospheric gas oil with a temperature range optimized for the highest content of hydrogen donor compounds, and a light stream (21) is separated comprising gas, LPG, gasoline and atmospheric gas oil. The stream (20) is the lightest component of the recycle solvent (5).

The stream (18) is parted into the streams (22) and (23). The stream (22) is a component of the recycle solvent (5). The stream (23) is supplied to a vacuum fractionating system (24), from whose bottom the stream (25) is separated, which has a high content of ashes and unconverted coal; this stream is parted into the two streams (26) and (27). The stream (26) is characterized by the same ash content as contained in the pre-treated coal (4) and such stream is supplied either to the gas producing unit for the production of hydrogen or to the production of the process utilities together with the stream (3); in such a way the collecting is prevented of the ashes in the recycle solvent. The stream (27), can not necessarily be a component of the recycle solvent (5).

The stream (28) separated from the top of the system of vacuum fractionating is practically consisting of a vacuum ash-free gas oil; such stream after having been mixed with the stream (29), comprising the unconverted matter, and with hydrogen is supplied (30) to the hydrocracking stage (31) for the purposes of optimizing the production rate of the intermediate distillates.

The reaction product from the hydrocracking stage (32) is supplied to the fractionating system (33) formed by a high- and low pressure separator and by an atmospheric flash, the stream (34) comprising the reaction products and the stream (35) comprising the unconverted matter being separated.

The stream (34) and the streams (10) and (21) form the stream (36), which is supplied to the final fractionating stage of the products of the liquefaction process (not shown in the figure), where the end products, LPG, gasoline, atmospheric gas oil, etc., are separated.

The unconverted matter (35) is partly recycled (37) to the hydrocracking stage and partly recycled (38) as a component of the recycle solvent.

In the figure, (39) represents the inlet of hydrogen from an external source to the plant.

DESCRIPTION OF THE SPECIFIC EMBODIMENTS

Two Examples will be now shown, with reference to the FIG. 1 enclosed.

EXAMPLE 1

A soft coal Illinois no 6 is used as the raw product having the following elemental composition:
(on MF=Moisture Free basis)
C: 69.53% by weight
H: 4.71% by weight
O: 11.02% by weight
N: 1.47% by weight
S: 2.93% by weight
ashes: 10.34% by weight The coal is submitted to a conventional pre-treatment stage of gravimetric type, to the purpose of reducing its content of ashes down to the value of 3% by weight. The production yield is of 61.5% of an energetic basis. The treated coal is crushed to a granulometry of 70–150 μm and is mixed with a recycle solvent consisting of:

Medium distillate 400°–700° F. (204°–372° C.) produced in the hydrotreating stage (20): 11.1% weight.

Bottom stream of the atmospheric fractionating stage (700° F., 372° C.,+) of the product resulting from the dissolving stage (12): 26.7% weight.

Bottom stream of the atmospheric fractionating (700° F., 372° C.,+) of the product resulting from the hydrotreating stage (22): 62.2% weight.

The streams (27) and (38) shown in the figure are missing. The ratio of the solvent to the coal is 1.8/1 by weight. The mixture is supplied to the dissolving reactor which is kept under the following operating conditions:

| | |
|---|---|
| Hydrogen partial pressure | 150 kg/sq. cm |
| Flow rate of recycle hydrogen mixture solvent/coal | 1.500 cu. m/cu. m of |
| Temperature | 440° C. |
| Contact time | 6 minutes |

The conversion rate in the reactor is of 90.3% by weight. The bottom stream resulting from the atmospheric fractionating of the product resulting from the dissolving stage is parted into the streams (12) and (13) with a ratio of 19.5/80.5 by weight. The stream (12) constitutes a fraction of the recycle solvent, as previously described. The stream (13) together with the hydrogen is supplied to the hydrotreating stage (14).

The concentration of the ashes in the charge is of 6.7% by weight. The operating conditions of the reactor are as follows:

| | |
|---|---|
| Hydrogen pressure | 150 kg/sq. cm |
| Temperature | 410° C. |
| Space speed (measured on the 700° F., 372° C. +stream), hours$^{-1}$ | 0.4 |
| Flow rate of the recycle hydrogen | 1.700 cu. m/cu. m of charge |

The catalyst of commercial type is formed by oxides of Ni and Mo on $Al_2O_3$, suitably previously sulphidized before the test.

The conversion rate of the charge, measured on the 700° F., 372° C.+stream, is of 28.8% by weight. From the atmospheric fractionating of the reaction product a cut is obtained in the range 400°–700° F. (204°–372° C.) (20) which is partly recycled to the dissolving reactor, as it has been previously shown. The bottom stream from the atmospheric fractionating stage (18) is parted into two streams (22) and (23) in the ratio 77.5/22.5. The stream (22) is recycled to the dissolving reactor as it has been previously shown; the stream (23) is supplied to the vacuum fractionating stage (24).

The bottom stream (25) from the vacuum fractionating unit, containing the 12.5% of ashes, is totally supplied to the gas producing unit (26); namely, the two streams (27) and (38) shown in the FIG. 1 are absent. The distillate stream from the vacuum distillation unit, 8.79% by weight with reference to the weight of the coal supplied to the dissolving stage, is supplied to the hydrocracking stage where it is completely converted. The operation conditions are:

| | 1st reactor | 2nd reactor |
|---|---|---|
| Hydrogen pressure, kg/sq. cm | 120 | 120 |
| Temperature, °C. | 350 | 400 |
| Space speed, hours$^{-1}$ | 0.5 | 0.5 |
| Flow rate of the recycle hydrogen, cu. m/cu. m of charge | 1.700 | 1.700 |

In the first hydrocracking reactor a commercial catalyst is used comprising oxides of Ni and Mo on $Al_2O_3$; in the second reactor, a commercial catalyst is used comprising oxides of Ni and W on $SiO_2/Al_2O_3$. Both the catalysts are pre-sulphidized before being used. The conversion rate is of 61.0% by weight, with reference to the weight of the charge.

The general operating balance was as follows:

| | |
|---|---|
| Coal (MF) supplied to the dissolving stage | 100% by weight |
| Hydrogen | 4.27% by weight |
| Total | 104.27% by weight |

| Resulting products | |
|---|---|
| Gas ($H_2O$, $H_2S$, $NH_3$, $C_1$–$C_4$) | 20.72% |
| Gasoline ($C_5$–400° F., 204° C.) | 17.87% |
| Atmospheric gas oil (400–700° F., 204–372° C.) | 41.68% |
| Residue to the gas producing unit (26) | 24.00% |
| TOTAL PRODUCTS | 104.27% |

EXAMPLE 2

The same coal, pre-treated in the same way as shown in the previous Example 1, is mixed with a recycle solvent, consisting of:

Medium distillate 400°–700° F. (204°–372° C.) resulting from the hydrotreating stage (20): 12.5%.

Bottom stream from the atmospheric fractionating of the product resulting from the dissolving stage (12): 35.0%.

Bottom stream from the atmospheric fractionating of the product resulting from the hydrotreating stage (22): 35.0%.

Bottom stream from the vacuum fractionating stage of the product resulting from the hydrotreating stage (27): 17.5%.

The stream (38) shown in the figure is missing. The ratio of the weight of the solvent to the weight of the coal is 1.8/1 by weight.

Under the same operating conditions as shown in the previous Example 1 a conversion is obtained of the coal in the dissolving stage of 90.1% by weight.

The bottom stream (11) from the atmospheric fractionating stage is parted into the streams (12) and (13) in the ratio of 26/74 by weight.

The stream (12) forms a fraction of the recycle solvent as it has been previously shown.

The stream (13), containing the 7.12% by weight of ashes, is treated in the hydrotreating stage under operating conditions which are the same as shown in the previous Example 1.

The conversion rate calculated on the 700° F. (372° C.)+stream is of 25.3% by weight.

From the atmospheric fractionating of the reaction product a cut is obtained 400°–700° F. (204°–372° C.) (20) which is partly recycled to the dissolving reactor is previously shown.

The bottom stream resulting from the atmospheric fractionating (18) is parted into the two streams (22) and (23) in the ratio 46/54.

The stream (22) is recycled to the dissolving reactor as shown; the stream (23) is supplied to the vacuum fractionating stage.

The bottom stream (25) from the vacuum fractionating stage is parted into the two streams (26) and (27) in the ratio 43/57 of weight.

The stream (26) is supplied to the gas producing unit and the stream (27) constitutes a component of the recycle solvent, as shown.

The vacuum distillate, 19.19% by weight of the weight of coal supplied to the dissolving stage, is supplied to the hydrocracking stage where it is extinguished.

The conversion under the same operating conditions as shown in the previous Example no 1 is of 59.5% by weight. The general balance of the processing was:

| | |
|---|---|
| Coal supplied to the dissolving unit | 100.0% weight |
| Hydrogen | 4.31% weight |
| Total | 104.31% weight |

| Resulting products | |
|---|---|
| Gas ($H_2O$, $H_2S$, $NH_3$, $C_1$–$C_4$) | 20.44% by weight |
| Gasoline ($C_5$-400° F., 204° C.) | 18.51% by weight |
| Residue to the gas producing unit (26) | 23.90% by weight |
| TOTAL PRODUCTS | 104.31% by weight |

We claim:

1. A process for the direct liquefaction of coal, comprising the following steps:

(a) subjecting the coal to a pre-treatment to reduce the ash content of such coal;

(b) mixing the pre-treated coal with a solvent and subjecting the mixture to a dissolution reaction and then (ii) fractionating the product resulting from the dissolution reaction to separate a light stream containing gaseous products, LPG, gasoline and atmospheric gas oil and a heavy stream comprising an atmospheric residue containing ashes and unreacted coal;

(c) (i) subjecting to a hydrotreating reaction a portion of the heavy stream comprising the atmospheric residue, (ii) recycling the balance of the heavy stream as a part of the solvent to be mixed with the pre-treated coal before it is subjected to the dissolution reaction in step (b), (iii) then fractionating the product from the hydrotreating reaction to separate a gaseous stream and a bottom stream consisting of the atmospheric residue, (iv) fractionating the gaseous stream to separate a light stream comprising gaseous products, LPG, gasoline and atmospheric gas oil and a stream which is recycled as a fraction of the solvent to be mixed with the pre-treated coal before it is submitted to the dissolution reaction, and (v) separating the bottom stream into two parts, one of which is recycled as a fraction of the solvent, the other of which is fractionated to separate therefrom a top stream consisting essentially of a vacuum gas oil free of ashes and a bottom stream with a high content of ashes and unconverted coal, such bottom stream being supplied to the gas generating unit for the production of hydrogen;

(d) (i) subjecting to a hydrocracking treatment a stream containing the vacuum gas oil, (ii) fractionating the product resulting from the hydrocracking stream containing gaseous products, LPG, gasoline and atmospheric gas oil, and (iii) supplying this gaseous stream, together with the light stream from the dissolution reaction from step (b) (ii) and the light stream from the fractionating stage of the gaseous stream from the hydrotreating in step (c) (iv), to a final fractionating stage to separate the end products from a stream comprising unconverted matter which is to be mixed with the stream containing the vacuum gas oil before it is submitted to the hydrocracking stage, of part d(i).

2. A process as claimed in claim 1, wherein at least a part of the stream comprising the unconverted matter from step (d) is recycled as a fraction of the solvent to be mixed with the pre-treated coal before it is supplied to the conversion stage.

3. A process as claimed in claim 1, wherein at least a part of the bottom stream with a high content of ashes and unconverted coal from step (c) is recycled as a fraction of the solvent to be mixed with the pretreated coal before it is submitted to the dissolution reaction.

4. A process as claimed in claim 1, wherein the dissolution is carried out at a temperature in the range from 300° C. to 500° C., with a contact time in the range from 1 minute to 60 minutes, at a hydrogen pressure not higher than 350 kg/sq.cm., with a flow rate of the hydrogen recycle in the range between 400 and 4,000 cu.m/cu.m of the solvent/coal mixture.

5. A process as claimed in claim 1, wherein the hydrotreating reaction is carried out at a temperature in the range from 350° to 450° C., at a space speed in the range from 0.2 to 2.5 hours$^{-1}$, at a pressure in the range from 50 to 350 kg/sq.cm, with a flow rate of the recycle of the hydrogen in the range from 350 to 3,500 cu.m/cu.m of charge.

6. A process as claimed in claim 1, wherein the hydrocracking treatment is effected in two reactors, of which the first is operated at a temperature in the range from 300° C. to 400° C., at a hydrogen pressure in the range from 50 to 200 kg/sq.cm and with a flow rate of the recycled hydrogen from 300 to 1,700 cu.m/cu.m and the second reactor is operated at a temperature in the range from 350° C. to 450° C., at a space speed in the range from 0.2 to 1.5 hours$^{-1}$, at a hydrogen pressure in the range from 50 to 200 kg/sq.cm, and with a flow rate of the recycled hydrogen in the range between 300 and 2,500 cu.m/cu.m.

7. A process as claimed in claim 1, wherein the ratio of the weight of the solvent to the weight of the coal is in the range from 0.5 to 5.

8. A process as claimed in claim 4, wherein the dissolution is carried out with a contact time in the range from 3 to 15 minutes.

9. A process as claimed in claim 7, wherein the weight ratio of the solvent to the coal is in the range from 1 to 2.

* * * * *